US006588698B2

(12) United States Patent
Gangemi et al.

(10) Patent No.: US 6,588,698 B2
(45) Date of Patent: Jul. 8, 2003

(54) WINDING MACHINE INCLUDING A FINGER SENSOR ADJACENT THE NIP FORMED BETWEEN A SUPPORT DRUM AND A WEB REEL

(75) Inventors: Donald Gangemi, Great Barrington, MA (US); Thomas Hitchko, Lee, MA (US); J. Michael McKenney, Lenox, MA (US)

(73) Assignee: GL&V Management Hungary kft

( * ) Notice: Subject to any disclaimer, the term of this patent is extended or adjusted under 35 U.S.C. 154(b) by 0 days.

(21) Appl. No.: 09/994,268

(22) Filed: Nov. 26, 2001

(65) Prior Publication Data

US 2003/0098382 A1 May 29, 2003

(51) Int. Cl.[7] ..... B41F 33/00
(52) U.S. Cl. ..... 242/913; 242/534; 242/548
(58) Field of Search ..... 242/913, 534, 242/542, 542.1, 542.2, 542.4, 548

(56) References Cited

U.S. PATENT DOCUMENTS

| | | | | | |
|---|---|---|---|---|---|
| 1,306,711 | A | * | 6/1919 | O'Malley | 242/539 |
| 1,575,088 | A | * | 3/1926 | Bartlett | 74/613 |
| 1,713,382 | A | * | 5/1929 | Hammel et al. | 242/539 |
| 3,104,845 | A | * | 9/1963 | Patterson, Jr. et al. | 242/541.6 |
| 4,295,421 | A | * | 10/1981 | Abendroth et al. | 101/216 |
| 4,485,980 | A | | 12/1984 | Gorner | |
| 4,867,055 | A | * | 9/1989 | Hutter et al. | 100/173 |
| 4,905,596 | A | | 3/1990 | Kobler | |
| 4,987,277 | A | | 1/1991 | Duhon | |
| 5,024,155 | A | * | 6/1991 | Jahn | 101/216 |
| 5,427,020 | A | | 6/1995 | Conrad et al. | |
| 5,537,922 | A | * | 7/1996 | Becker | 101/216 |

* cited by examiner

*Primary Examiner*—Kathy Matecki
*Assistant Examiner*—Sang Kim
(74) *Attorney, Agent, or Firm*—James Earl Lowe, Jr.

(57) ABSTRACT

This invention provides a winding machine comprising a support drum, a winding tube at least partially supported on the support drum, and a web of material being wound around the winding tube to form a web reel in response to rotation of the support drum and the web reel, the point where the web reel rotates into contact with the support drum being called the nip. The winding machine further includes a nip safety guard comprising a finger presence sensor, a support mechanism supporting the finger presence sensor adjacent one of the web reel and the support drum, and a moving mechanism that moves and locates the finger presence sensor support mechanism depending on the size of the web reel so that the finger presence sensor is located closely adjacent the one of the web reel and the support drum and spaced a safe distance from the nip. The safety guard moving mechanism further includes a control for determining the size of the web reel and operating the moving mechanism to position the finger sensor. More particularly, the winding machine nip safety guard comprises a safety shield that covers the support drum and is mounted for rotation about the support drum, the safety shield having an edge adjacent the nip, and the moving mechanism moves the safety shield away from the nip during higher speed winding and towards the nip when winding at significantly lower speeds.

10 Claims, 2 Drawing Sheets

WINDING MACHINE INCLUDING A FINGER SENSOR ADJACENT THE NIP FORMED BETWEEN A SUPPORT DRUM AND A WEB REEL

BACKGROUND OF THE INVENTION

The invention relates to improvements in machines for winding webs of material like paper onto web reels. More particularly, the invention relates to improvements in guards for the inlet sides of nips between various rolls, drums and reels in such machines. Still more particularly, the invention relates to machines where the size of the reel being wound and forming the nip increases over time.

SUMMARY OF THE INVENTION

This invention provides a winding machine comprising a support drum, a winding tube at least partially supported on the support drum, and a web of material being wound around the winding tube to form a web reel in response to rotation of the support drum and the web reel, the point where the web reel rotates into contact with the support drum being called the nip. The winding machine further includes a nip safety guard comprising a finger presence sensor, a support mechanism supporting the finger presence sensor adjacent one of the web reel and the support drum, and a moving mechanism that moves and locates the finger presence sensor support mechanism depending on the size of the web reel So that the finger presence sensor is located closely adjacent the one of the web reel and the support drum and spaced a safe distance from the nip. The safety guard moving mechanism further includes a control for determining the size of the web reel and operating the moving mechanism to position the finger sensor. More particularly, the winding machine nip safety guard comprises a safety shield that covers the support drum and is mounted for rotation about the support drum, the safety shield having an edge adjacent the nip, and the moving mechanism moves the safety shield away from the nip during higher speed winding and towards the nip when winding at significantly lower speeds. The safe distance is one so that if a finger is sensed, the winding of the web reel can be stopped in time to prevent the finger from reaching the nip. More particularly, the safety shield has an edge adjacent the nip, and the finger presence sensor is mounted on the safety shield edge.

In the preferred embodiment, the safety shield covers the support drum, and the safety guard moving mechanism is mounted for rotation about the axis of the support drum.

The principal feature of the invention is the provision of a safety guard that moves up to the nip when the web reel is being rethreaded and positions itself so that a finger sensor is adjacent the nip to stop the winding machine if a finger is sensed near the nip.

Figure 1:
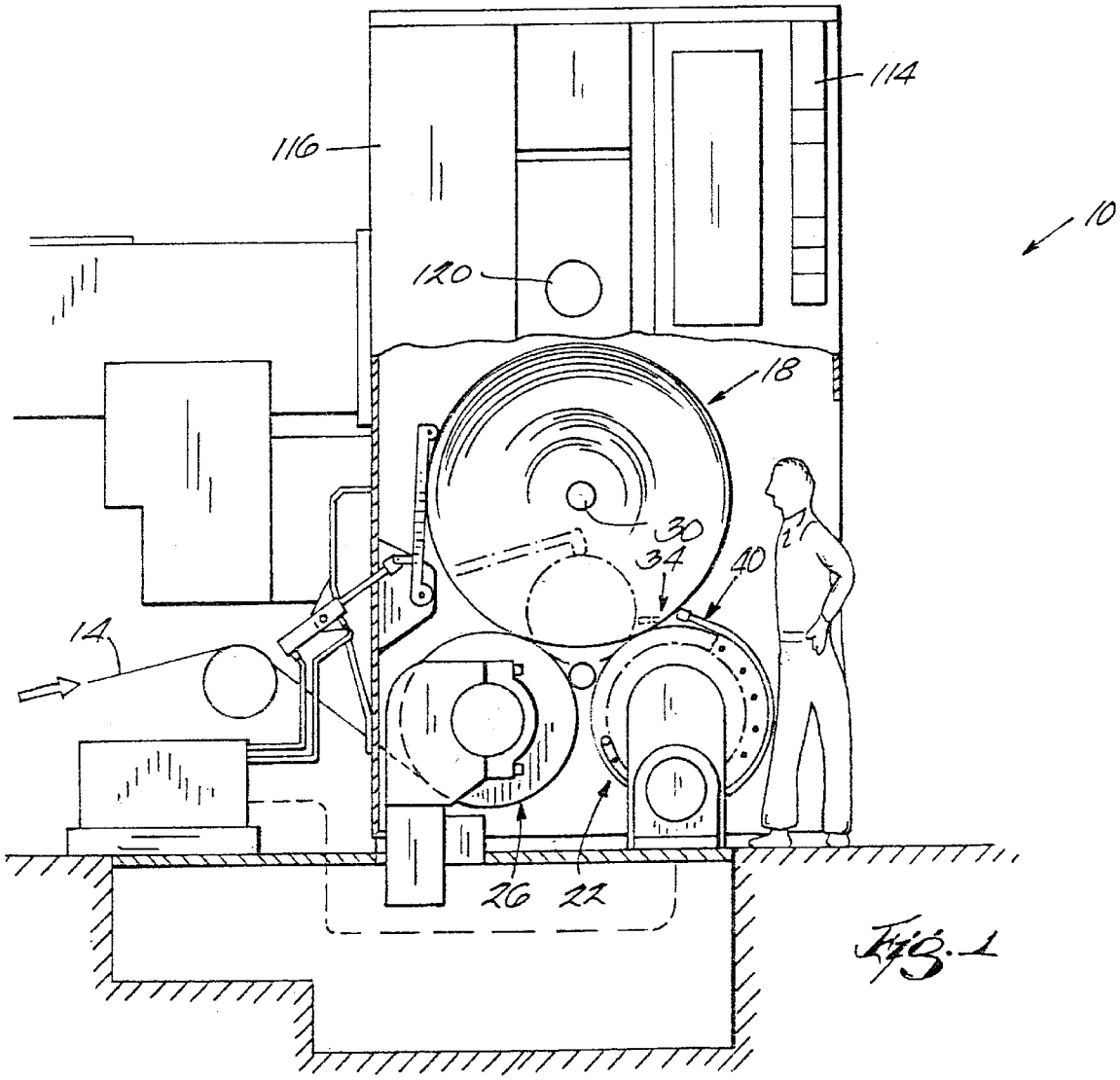
FIG. 1 is a side elevational view of a winding machine with a safety guard embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is, to be understood that the phraseology and terminology used herein is for the purpose of description and should not be regarded as limiting. Use of "including" and "comprising" and variations thereof, as used herein is meant to encompass the items listed thereafter and equivalents thereof as well as additional items. Use of "consisting of" and variations thereof as used herein is meant to encompass only the items listed thereafter and equivalents thereof.

DESCRIPTION OF THE PREFERRED EMBODIMENTS OF THE INVENTION

As more particularly shown in the drawings, the invention provides a winding apparatus 10 for winding a web 14 into a web reel 18, the apparatus comprising first 26 and second supporting drums 22, each of which, at least partially supports the reel 18, the supporting drums being positioned parallel to one another, and spaced apart with the web passing partially around the first supporting drum 26 and into the reel 18. In other embodiments (not shown) a single supporting drum can be used.

The web of material, which in the preferred embodiment is paper, is wound around a winding tube 30 to form web reel 18 in response to rotation of at least one of the support drums and the web reel 18, the point where the web reel 18 rotates into contact with the second support drum 22 being called the nip 34.

In the winding machine illustrated in FIG. 1, the support drums 22 and 26 rotate counter clockwise and the web reel 18, rotates clockwise.

The winding machine 10 also includes a braking device (typically the drive motor, not shown) for stopping rotation of the support drums and the web reel when commanded by a control to do so.

Still more particularly, the winding machine 10 further includes, (as shown generally in FIG. 1 and more particularly in FIG. 3) a nip safety guard 40 comprising a finger presence sensor 44, and a drum safety, shield 48 that covers one of said web reel and the support drum. When the web reel 18 is being wound, the safety guard 40 pivots down (not shown) away from the reel, 18. An operator is separated from the winding machine during winding by a barrier 114 supported by a housing 116. But in the event of a web break, an operator needs to come in and help rethread the machine. More particularly, the drum safety guard 40 covers the support drum 22 closest to a operator when the operator is aiding in the rethreading of the winding machine after a web break. During rethreading, the web reel turns at a slower rate, but one that can cause the operator to have a finger enter the nip. The safety guard then, when the operator approaches the winding machine to rethread the web reel, causes the finger sensor 44 on the edge of the drum safety guard shield 48 nearest the nip 34 to stop about a quarter of an inch from the reel 18. The finger sensor 44 is responsive to finger pressure to quickly shut down the winding machine if an operator's finger gets near the nip 34. The drum 22 will move only about an inch before shutting down, and the nip 34 is a safe distance (about 4 inches away) from the finger sensor 44.

The safety guard finger presence sensor 44 is in the form of a tape switch mounted on the edge of the safety guard shield 48 adjacent the nip 34. The tape switch 44 comprises a normally closed pressure sensitive electrical switch, such as that described in Duhon, U.S. Pat. No. 4,987,277, which is incorporated herein by reference. In other embodiments, other finger presence sensing devices can be used. See for example the finger presence sensing devices shown in John, U.S. Pat. No. 5,024,155 and Becker, U.S. Pat. No. 5,537,922. During rethreading, the web of material being wound on the reel is likely to come into contact with the finger sensor. In order to function properly, the finger sensor must be sensitive enough to respond to a finger passing between the finger sensor and the web reel, but not so sensitive as to respond to the presence of web material passing over the finger sensor.

The position of the tape switch 44 is generally such that it is located ¼ of an inch away from the web reel 18. The safety guard 40 also covers the support drum 22 since it curves around the drum. Thus, the only way for an operator to have access to the nip 34 is between the safety guard 40 and the web reel 18. Since the location of the Outer surface of the web reel is dependent on the increasing size of the reel, the edge of the safety guard 40 is positioned depending on the size of the reel 18 (see the change in reel size shown in FIG. 1), as more fully described below.

The safety shield 48 is in the form of a quarter of a cylinder. The safety shield 48 has a slightly larger radius of curvature than the second support drum to allow adequate clearance between the shield and the drum at all points. The safety shield 48 is positioned about one inch radially further outward from the surface of the second support drum 22 and is mounted for pivotal movement about the axis of the second drum 22, as more particularly described below. In other embodiments, not shown, the safety shield can be mounted so that it pivots about an axis other than the axis of the second support drum 22. Further, in other embodiments, any means providing a finger sensor 44 adjacent the nip 34 can be used. For example, a transmitter and a receiver having a light beam traveling between two arms (not shown) can be used, each arm being pivotally mounted at the ends of the second support drum so that the light beam receiver will sense the presence of an operator's finger near the nip 34. The light beam can be positioned by pivoting the arms so that the light beam remains in a position adjacent the nip, as described, herein, as the size of the web reel changes. The interference with the light beam would have to be adjusted however so that the passing of web material temporarily through the beam would not shut down the winding machine, but the passing of a finger would shut down the machine.

Figure 3:
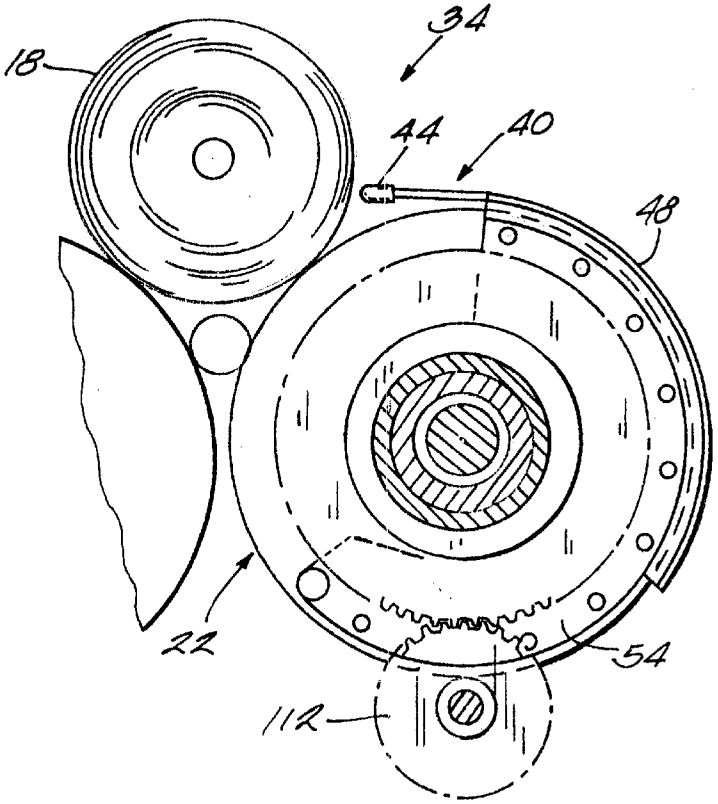
FIG. 3 is a partially broken away end view of a portion of the support drum and the safety guard, as taken along line 3—3 in FIG. 2.

The winding machine 10 also includes a support mechanism 50 supporting the finger presence sensor 44 adjacent one of the web reel 18 and said support drum 22. More particularly (as shown in FIGS. 1 and 3), the safety shield 48 is supported at each end of the adjacent second support drum 22. In order to move the edge of the safety shield 48 as well as to move the safety guard down away from the nip during the normal winding process, the support mechanism 50 provides for pivoting of the safety guard 40. More particularly, the safety guard is pivotally mounted at each end of the support drum 22 (only one end is shown) about the axis of the support drum 22 by a side plate 54 welded and pinned to the safety shield 48. The drum 22 is supported for rotation as is conventional in the art by a drum stand 58 mounted on the floor 62 of the winding machine 10. A drum journal 66 extends from the drum 22 and is received in the drum stand 58 and is rotatably supported by drum journal bearings 70. The drum journal 66 is surrounded by a drum journal cap 74 which is secured to the side of the drum stand 58. In other embodiments (not shown), a separate bearing housing and a bearing cap can be mounted on the drum stand 58. The safety guard side plate 54 encircles the drum journal cap 74. The side plate 54 is mounted for rotation around the drum journal cap 74 by a bronze bushing 78. A bull gear 82 is secured to the side plate 54 by pins 86, and rotates about the axis of rotation of the support drum 22.

The winding machine 10 also includes a mechanism 91 for moving the safety guard support comprising a motor 92 and a transmission 96 for connecting the motor 92 to the safety guard 40. The motor 92 comprises a motor shaft 100 that extends into a gearbox 104. A drive shaft 108 extends from the gearbox 104 and extends parallel to the axis of the second support drum 22. Drive gears 112 are mounted on the drive shaft 108 at each end of the second support drum, and each engages one of the bull gear 82 (only one is shown). Operation of the motor 92 thus serves to rotate the drive shaft 108, rotating the drive gears 112, which in turn rotate the bull gears 82 and the safety guard 40.

The moving mechanism moves and locates the finger presence sensor support mechanism depending on the size of the web reel so that the finger presence sensor is located closely adjacent the web reel and spaced a safe distance from the nip. More particularly, the moving mechanism moves the safety shield both towards and away from the nip. Still more particularly, the safe distance is one so that if a finger is sensed, the winding of the web reel 18 is stopped by stopping the drum and reel rotation and operating the brake in time to prevent the finger from reaching the nip 34.

Still more particularly, the support mechanism permits the pivoting of the drum guard 40 in the event of a break in the web 14 being wound onto the reel 18. Normally, the winding machine 10 is enclosed in a housing 116 (see FIG. 1) that prevents the operator from being in the area adjacent the reel 18 being wound. At this time, the safety guard is pivoted by the moving mechanism downward (clockwise in FIGS. 1 and 3) so the safety guard 40 does not interfere with the high speed winding of the reel 18. In the event of a web break, however, an operator may need to assist in the rescuing of the web 14 to the reel 18. While the web 14 is being rethreaded onto the reel 18, the support drums rotate at a rate of about 30 feet per minute. Although this is a relatively slow rate, if an operator accidentally reaches into the nip 34 formed between the support drum 22 and the reel 18, the operator's arm and the operator can be drawn into the nip 34, thus resulting in the loss of the operator or the operator's arm. The safety guard 40 is then pivoted upward (counterclockwise in FIGS. 1 and 3) so that the finger sensor 44 is adjacent the reel 18.

The winding machine 10 also includes a load roller mechanism 120 for providing a force on the web reel 18 so the nip pressure is relatively constant while the size of the web reel changes. The web reel core is also held in a core chuck, (not shown), one of which is located at each end of the reel being wound.

Figure 2:
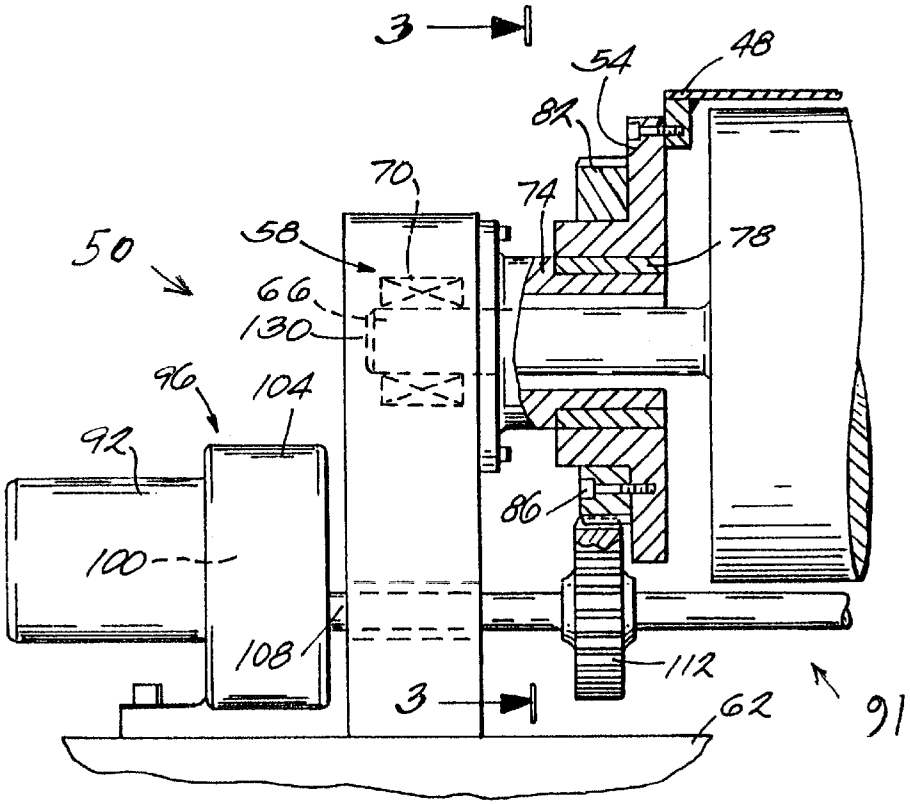
FIG. 2 is a partially broken away side view of end of the drum showing the mounting of the safety guard on the ends of the support drum.

The winding machine also includes a control for determining the size of the web reel and for controlling the moving mechanism in order to place the finger sensor adjacent the web reel. More particularly, The size of the web reel 18 is known by an encoder 130 (see FIG. 2) on the end of the drum journal 66 that counts the number of times the support drum 22 has been rotated, and an encoder (not shown) on the core chuck that counts the number of times the core chuck is rotated relative to the support drum. Further, the size of the web reel can also be determined by the vertical location of either the core chuck or the load roller. In the preferred embodiment, the relative rotation of the first support drum and the core chuck is used to determine the size of the web reel 18. This information is then supplied to a programmable logic controller (PLC), and information stored in the PLC then relates the encoder output to the desired location of the finger sensor, and operates the motor 92 to position the safety guard 40 adjacent the web reel.

What is claimed is:

1. A winding machine comprising:

a support drum, a winding tube at least partially supported on said support drum, a web of material being wound around the winding tube to form a web reel in response to rotation of the support drum and the web reel, the point where the web reel rotates into contact with the support drum being called a nip, and a nip safety guard comprising a finger presence sensor, a support mechanism supporting said finger presence sensor adjacent one of said web reel and said support drum, and a moving mechanism that moves and adjusts said finger presence sensor support mechanism depending on the size of the web reel so that the finger presence sensor is located closely adjacent said one of said web reel and said support drum and spaced a safe distance from the nip.

2. A winding machine in accordance with claim 1 wherein the safe distance is one so that if a finger is sensed, the winding of the web reel can be stopped in time to prevent the finger from reaching the nip.

3. A winding machine in accordance with claim 1 wherein the safety guard further includes a safety shield that covers one of said web reel and said support drum, said safety shield having an edge adjacent the nip, and wherein the finger presence sensor is mounted on said safety shield edge.

4. A winding machine in accordance with claim 3 wherein said safety shield covers said support drum.

5. A winding machine in accordance with claim 4 wherein said safety guard moving mechanism is mounted for rotation about the axis of the support drum.

6. A winding machine in accordance with claim 3 wherein said safety guard moving mechanism moves said safety shield both towards and away from the nip.

7. A winding machine in accordance with claim 1 wherein said safety guard moving mechanism further includes a control for determining the size of the web reel and operating the moving mechanism to position the finger sensor.

8. A winding machine in accordance with claim 1 wherein said one of said web reel and said support drum is said web reel.

9. A winding machine comprising:

a support drum, a winding tube at least partially supported on said support drum, a web of material being wound around the winding tube to form a web reel in response to rotation of the support drum and the web reel, the point where the web reel rotates into contact with the support drum defining a nip, and a nip safety guard comprising a safety shield that covers said support drum and is mounted for rotation about said support drum, said safety shield having an edge adjacent the nip, and a support mechanism supporting said finger presence sensor adjacent one of said web reel and said support drum, and a moving mechanism that moves said safety shield away from the nip during higher speed winding and towards the nip when winding at significantly lower speeds.

10. A nip safety guard adapted to be secured to a winding machine comprising:

a support drum, a winding tube at least partially supported on said support drum, and a web of material being wound around the winding tube to form a web reel in response to rotation of the support drum and the web reel, the point where the web reel rotates into contact with the support drum being called a nip, the nip safety guard comprising a finger presence sensor, a support mechanism supporting said finger presence sensor adjacent one of the web reel and the support drum, and a moving mechanism that moves and locates said finger presence sensor support mechanism depending on the size of the web reel so that the finger presence sensor is located closely adjacent said one of said web reel and said support drum and spaced a safe distance from the nip.

* * * * *